United States Patent [19]

Vijuk

[11] Patent Number: 4,616,815

[45] Date of Patent: Oct. 14, 1986

[54] AUTOMATIC STACKING AND FOLDING APPARATUS

[75] Inventor: Michael Vijuk, Oakbrook, Ill.

[73] Assignee: Vijuk Bindery Equipment, Inc., Elmhurst, Ill.

[21] Appl. No.: 708,300

[22] Filed: Mar. 5, 1985

[51] Int. Cl.[4] ..... B42C 1/00

[52] U.S. Cl. ..... 270/45; 271/210; 271/211; 271/221; 271/99; 271/94; 271/3.1

[58] Field of Search ..... 270/45–46, 270/59, 12, 15, 17; 271/210–211, 221–222, 3, 1, 94, 99

[56] References Cited

U.S. PATENT DOCUMENTS

| | | | |
|---|---|---|---|
| 2,569,219 | 9/1951 | Bamber et al. | 270/46 |
| 3,291,482 | 12/1966 | Stemmler | 271/94 X |
| 3,645,525 | 2/1972 | Ishihara et al. | 270/45 |
| 3,871,644 | 3/1975 | Stobb | 271/221 |
| 4,042,235 | 8/1977 | Wanner et al. | 271/94 |
| 4,168,832 | 9/1979 | Lewis et al. | 271/221 |
| 4,268,028 | 5/1981 | Martin | 271/221 |
| 4,346,882 | 8/1982 | Pessina et al. | 271/221 |
| 4,381,108 | 4/1983 | Newsome | 271/221 |

FOREIGN PATENT DOCUMENTS

| | | | |
|---|---|---|---|
| 962706 | 2/1975 | Canada | 271/221 |
| 284911 | 2/1928 | United Kingdom | 271/221 |

*Primary Examiner*—E. H. Eickholt

*Attorney, Agent, or Firm*—Fitch, Even, Tabin & Flannery

[57] ABSTRACT

The in-line web printing press 15 will be discharging shingled sheets at a rate set the press operator and operator of the stacking and folding machine 10 will set its speed of operation to match that of the web printing press. To this end, it is preferred to have an electric counter device 260 (FIG. 1) connected to a photocell 262 with the photocell actually counting each sheet passing underneath it on the alignment conveyor 22. A digital counter 264 on the electric counter device displays the operating speed so that the operator can match the speed precisely to that of the in-line web printing press. An electric motor control 266 has an adjustable knob 268 which changes the speed of the motor 270 which has its motor drive shaft 126 (FIG. 10) driving the side joggers 30 and the rear joggers 26. A motor 272 (FIG. 1) drives the alignment conveyor 22 and its speed may be adjusted by the operator at motor control device 274 having a control adjustment knob 276. The speed of the operation of the vacuum cylinder 40, the alignment conveyor 22 and the joggers 30 and 26 may be correlated and adjusted to the speed of the web printing press. The press speed is also varied for different types of paper to achieve the best performance and the speed control knobs 268 and 276 may be operated to vary the speeds in fine increments by the stacking and folding machine operator as well as the count on the digital counter 264.

16 Claims, 16 Drawing Figures

207
205
41
24
40
25
30
11
29
30
135
26
135
137
135
52
36
192
37
64
64
11
16
193
11

20
11
14
82a
26
82
82b
82b
37
78
64
109
112
14

82
82
102
78
105
106
101a
108
109
101
101
110
123
120
121
112
130
128
127
129
113
114

AUTOMATIC STACKING AND FOLDING APPARATUS

This invention relates to an automatic stacking and folding apparatus for a continuous traveling stream of sheets.

BACKGROUND OF THE INVENTION

The present invention is particularly directed to elimination of the current practice of using manual labor to remove printed and cut shingled sheets from a web printing press and loading them onto a pallet prior to folding the sheets. Then at a later date, the pallet is transported to an automatic folding machine at which another manual operation is used to remove the sheets from the pallet and to manually jog the sheets into alignment and then to place the sheets into a receiving hopper from which the sheets are fed by a bottom feeder into a folding station at which a device folds the sheets and provides a continuous outflow of printed folded sheets. The cost of these manual operations and the transportation of the pallets adds significantly to the cost of the ultimate printed fold sheet. Also, the pallets take considerable space and the transportation and storage of pallets are also space consuming. Hence, it would be more efficient to eliminate these separate operations and to be able to directly fold the printed sheets issuing from the web printing press.

It will be appreciated that the outflow of shingled sheets from the web printing press may be at a high rate of speed, for example, as many as 40,000 sheets per hour and that any folding apparatus connected thereto should operate at a similar high rate of speed without frequent breakdowns so that the web printing press may be kept operating at its full production speed.

The sheets leaving the web printing press are shingled on the conveyor and are not accurately aligned on the outcoming conveyor and can not be fed directly to the automatic folding machine because the sheets are too misaligned to be fed automatically from a stack by the existing folding machines. That is, the sheets are often skewed relative to one another with respective sheets being laterally misaligned, or turned slightly, and unevenly spaced in the fore and aft direction on the conveyer with the result that the sheets may not be directly fed into a receiving or storage hopper for automatic refeeding to a folder. Instead, it is the manual operator at the folding machine who corrects the misalignment of the sheets as he lifts the sheets and taps and jogs the same into general alignment prior to placing the aligned sheets into the feed hopper of the automatic folding machine.

Accordingly, a general object of the present invention is to provide an automatic folding machine with an automatic stacking station at which are collected and aligned incoming sheets so that the sheets may be automatically removed from the stack and folded by the folding machine in a continuous process.

A further object of the invention is to provide a new and improved automatic stacking and folding apparatus for connection directly to the output conveyor of a web printing press.

These and other objects and advantages of the other invention will become apparent when taken in conjunction with accompanying drawings in which:

DESCRIPTION OF THE PREFERRED EMBODIMENT OF THE INVENTION

Figure 2:
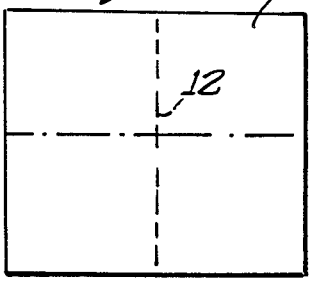
FIG. 2 is a plan view of a sheet which is to be folded.
Figure 3:
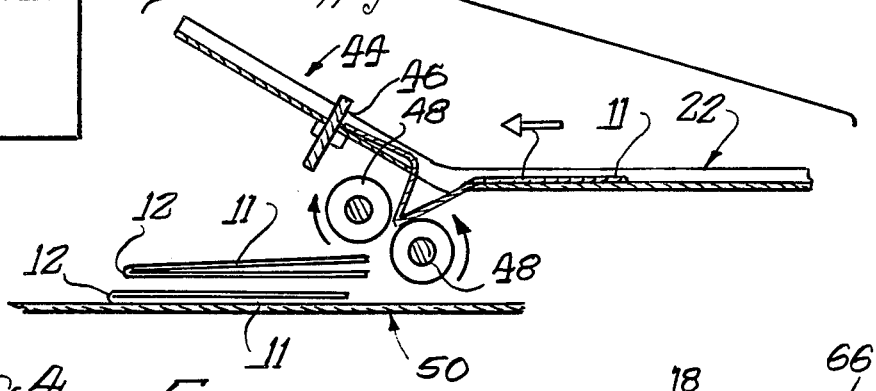
FIG. 3 is a diagrammatic view of the folding plate and the folding rollers constructed in accordance with the preferred embodiment of the invention.

As shown on the drawings for purposes of illustration, the invention is embodied in an apparatus for automatically folding sheets 11 which are usually rectangular sheets of paper, about a fold 12, as best seen in FIGS. 2 and 3 at a folding station 14. The sheets 11 have been printed and have been severed from a continuous web at a printing press 15 and a sheet transfer conveyer 16 transfers the shingled sheets to a stacking station 18 at the forward or inlet side of the automatic stacking and folding machine 10.

Heretofore, the shingled sheets 11 issuing from the web printing press 15 have been gathered manually as they issued from the press and mannually stacked and placed on pallets or in containers for later movement to a folding machine located at a different location. The shingled sheets issuing from the web printing press are not precisely aligned enough to constitute a stack which could be fed directly into a folding station 14. The printing press 15 is operating at high speeds, for example, 40,000 sheets per hour and there is a continuous flow of shingled sheets from the web printing press which can not be stopped in an economical manner to allow manual maintenance to remove misfed or misfolded sheets as a result of misaligned sheets being fed directly into conventional folding machine having the type of folding station illustrated in FIG. 1. Instead, the pallets carrying the manually stacked sheets are transported to another location at which another operator taps or jogs the edges of the sheet to form a neater stack which is then placed into a receiving tray, or stack holder from which the sheets are fed into a folding station. Additional building and floor space is required for the pallets and for the transportation devices for the pallets; and the two separate manual operations are desired to be eliminated. It is desirable to provide a folding and stacking machine which can directly and continuously handle the output of a high speed, web printing press 15 directly as by transferring the sheets from the press onto the transfer conveyer device 16 which provides a continuous stream of printed shingled sheets 11 to the stacking station 18.

Figure 1:
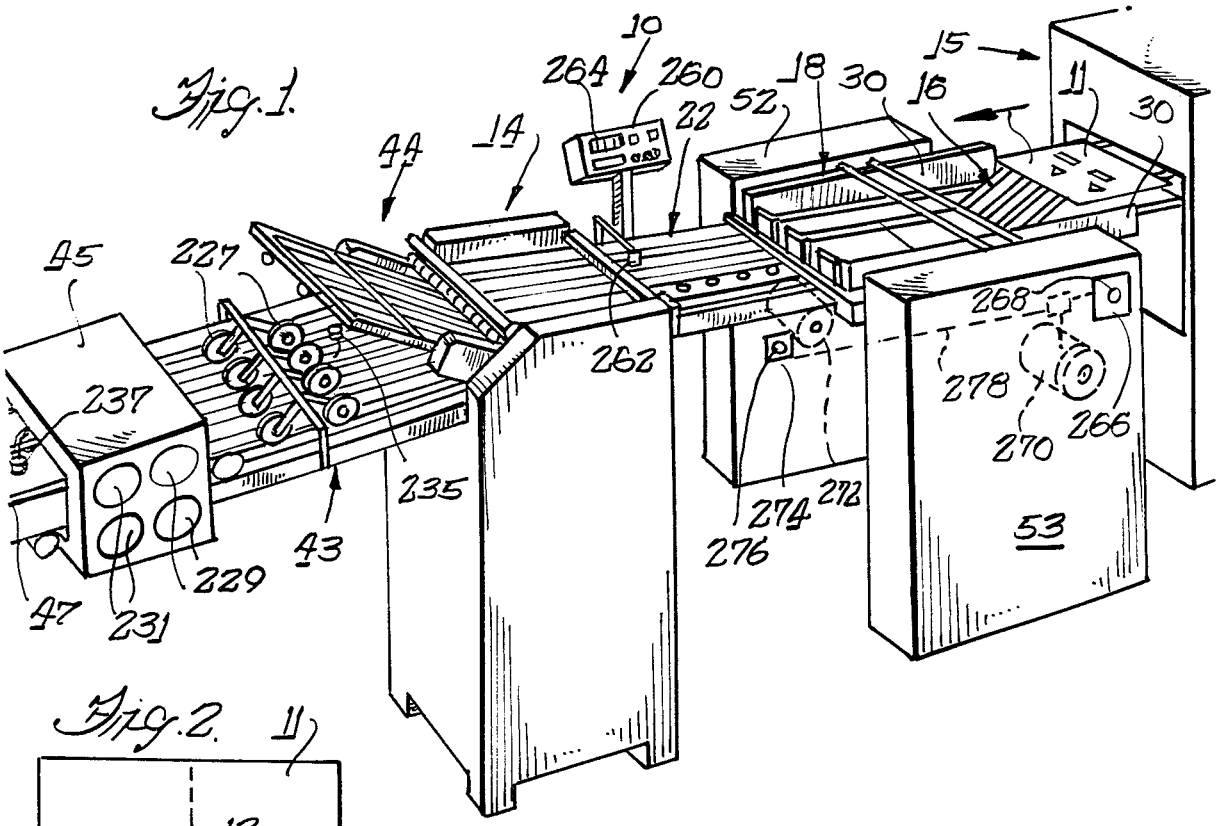
FIG. 1 is a schematic simplified partial view of an automatic stacking and folding machine constructed in accordance with the preferred embodiment of the invention.

In accordance with the present invention, the incoming shingled sheets 11 on the transfer conveyer 16 are deposited onto the top of a stack 20 of sheets at the stacking station 18, with the sheets being automatically jogged and aligned into the neat stack and, with the bottom sheet 11*a* (FIG. 5) being automatically fed from the bottom of the stack forwardly to an alignment conveyer 22 which delivers the sheet to the folding station 14. In accordance with the preferred method of the invention, each incoming sheet 11 is transported by the transport conveyor 16, as best seen in FIGS. 1 and 6, with the sheet being conveyed to abut its leading edge 24 (FIGS. 6 and 7) against a front stop or stop means 25 which limits the forward movement sheet in the direction of the arrow shown in FIG. 6 so that the sheet will be deposited on the top of the stack 20 of sheets 11 therebeneath. As the sheet drops onto the top of the stack, a lower or back jogger means 26 abuts and joggs a rear edge 27 (FIG. 13) of the incoming sheet against the front stop in case that the sheet has rebounded rearwardly from engagement with the rearward surfaces of the front stop 25. Also, continuously and simultaneously, the lateral sides or edges 28 and 29 of the sheet are abutted by a pair of oscillating side joggers 30 which extend along the longitudinal or lateral sides of the sheet and which are oscillated to abut the lateral edges to center the incoming sheet as well as the stack of sheets therebelow over a center line through the middle of the stacking station 18.

Figure 5:
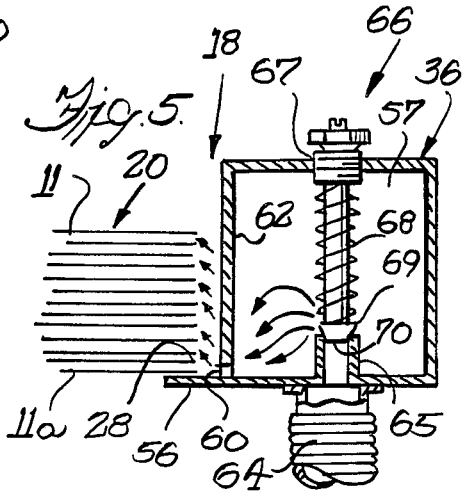
FIG. 5 is a cross sectional view taken substantially along the line 5—5 of FIG. 4 of an air valve used with the levitation air bar.
Figure 6:
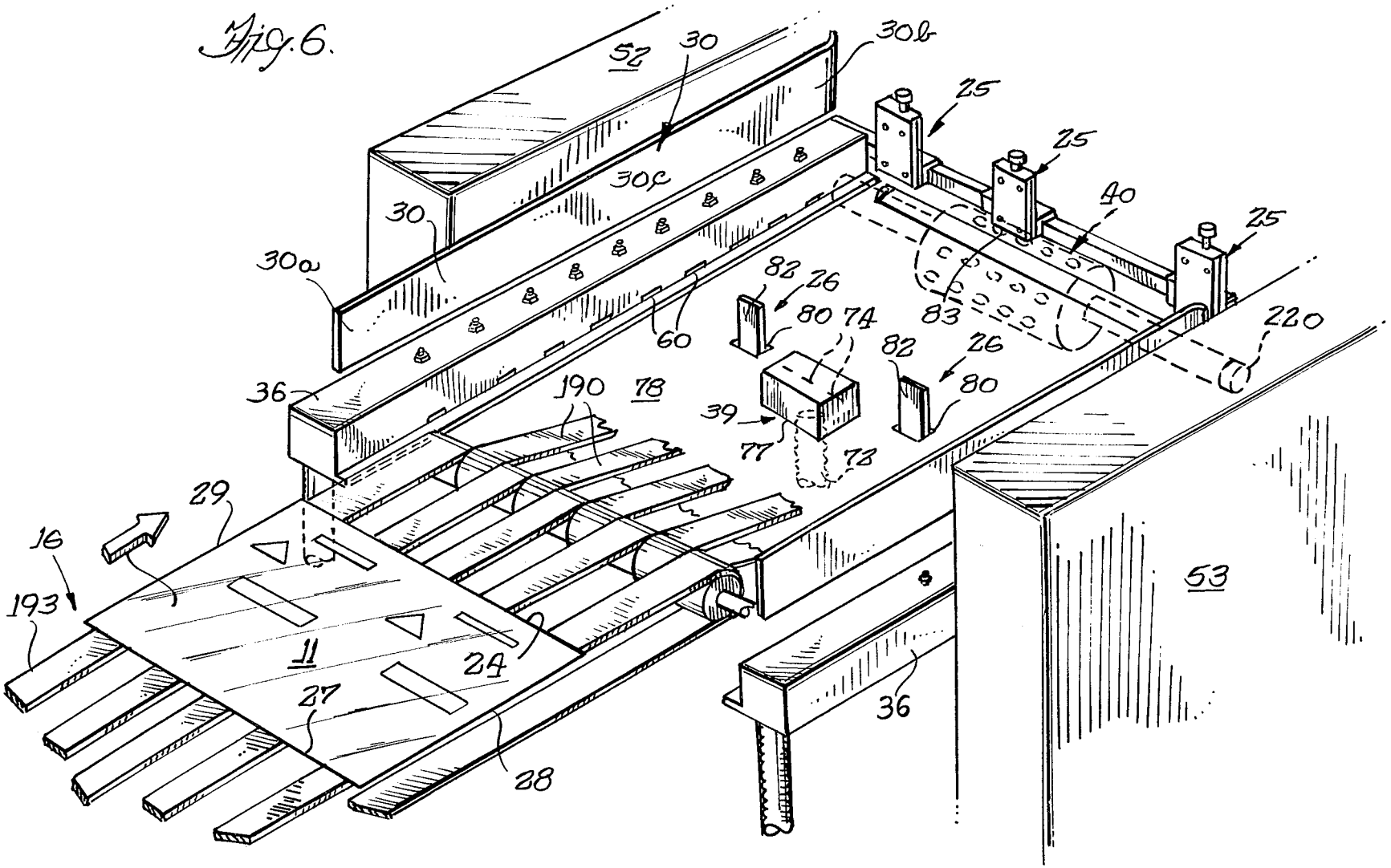
FIG. 6 is an enlarged, schematic, segmented, partial, perspective view of a stacking station a sheet transfer and a sheet transfer conveyer thereto.
Figure 7:
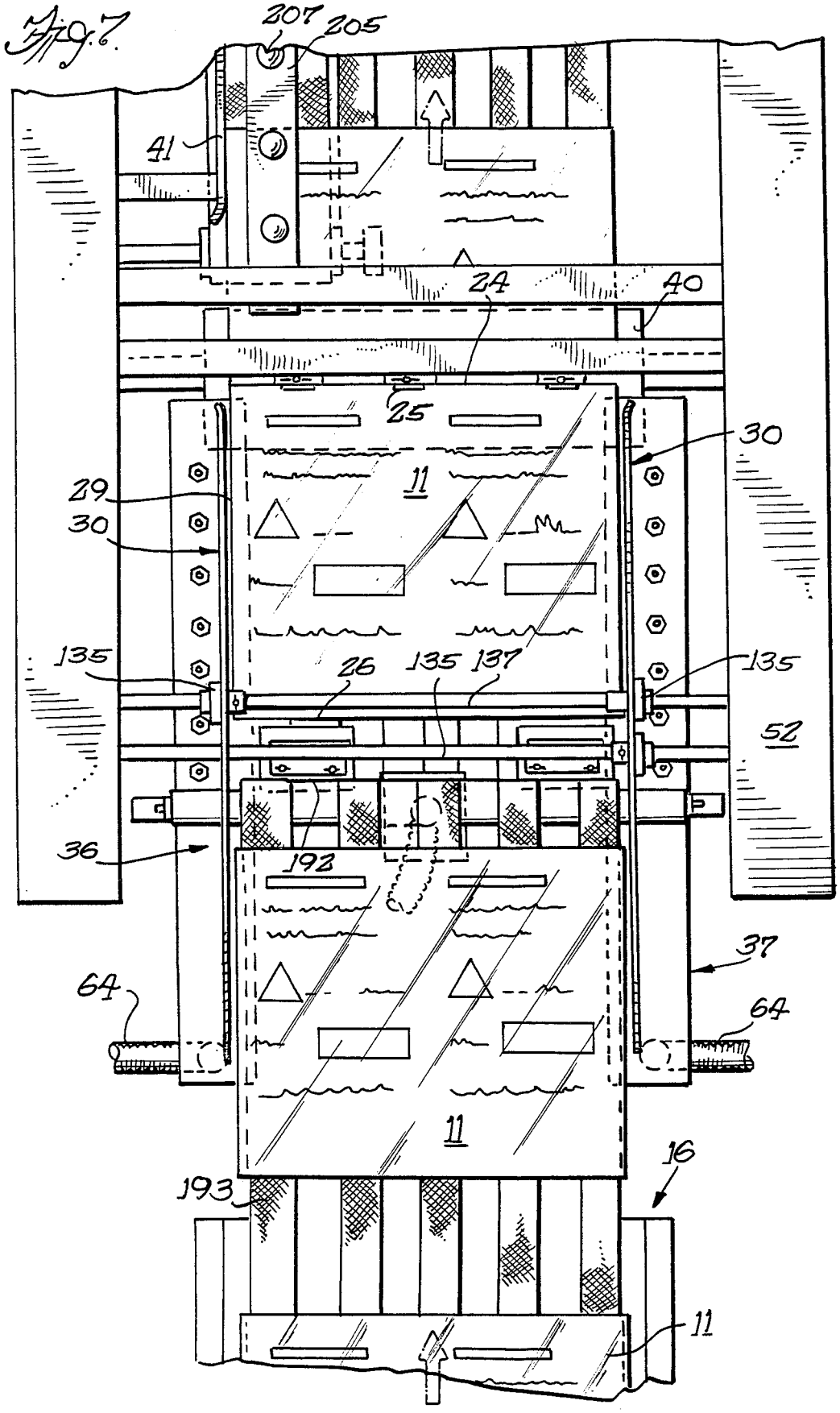
FIG. 7 is a plan view of the stacking station and transfer conveyer.

Also, in accordance with the preferred method of the invention, the sheets 11 are levitated within the stack 20, as best seen in FIG. 5, with the individual sheets 11 being separated from another by an air layer or cushion from air levitating means 34 which preferably comprises a pair of side air bars 36 and 37 as well as a rear air block 39 which is located rearwardly of the back joggers 26. The air layers keeps the sheets separated and floating in the stack and facilitates jogging of the sheets by allowing the sheets to slide over one another. Also, the floating of the sheets facilitates the removal of the lower sheet 11*a* from the stack, as the weight of the top sheets is substantially removed, by means of a pickoff or pickoff vacuum cylinder 40 which during each revolution picks off the leading edge of the lowermost sheet 11*a* and delivers the same to the alignment conveyer 22. The alignment conveyer assures lateral edge 29 of the sheet is precisely located by side edge guide 41, as best seen in FIG. 7, extending from the stacking station to the folding station. The alignment conveyer 22 delivers the sheet in this embodiment of the invention into the folding station which it preferably is of a well known design include an upwardly inclined folding plate 44. The illustrated folding device is a commercially and available and well known folding device and hence will not be described in detail. The leading edge of the sheet, as best seen in FIG. 3, abuts an abutment bar 46 and this causes a portion of the sheet to buckle at the fold line 12 which is in the nip of a pair of folding rollers 48 which grip the buckled centered portion of the sheet and pull the latter into and through the rollers 48 and discharge the folded sheet in a folded condition, as best seen in FIG. 3, onto a discharge belt conveyer 50 which then carries off the folded sheets which are issuing in a continuous manner and at a high rate such as to match the speed of the press 15.

The sheets 11 after being folded are called signatures or leaflets. Often the folding device includes one to eight folding plates and the sheets are folded one at each folding plate. Also, the folding device often has a shearing device (not shown) which cuts the sheet in half so that 40,000 per hour in feed of sheets results in 80,000 signatures. Preferably, such high outputs are also automatically stacked and counted in a signature stacking means or device 42 (FIGS. 1 and 15) which is connected to the output side of the folding device.

Figure 15:
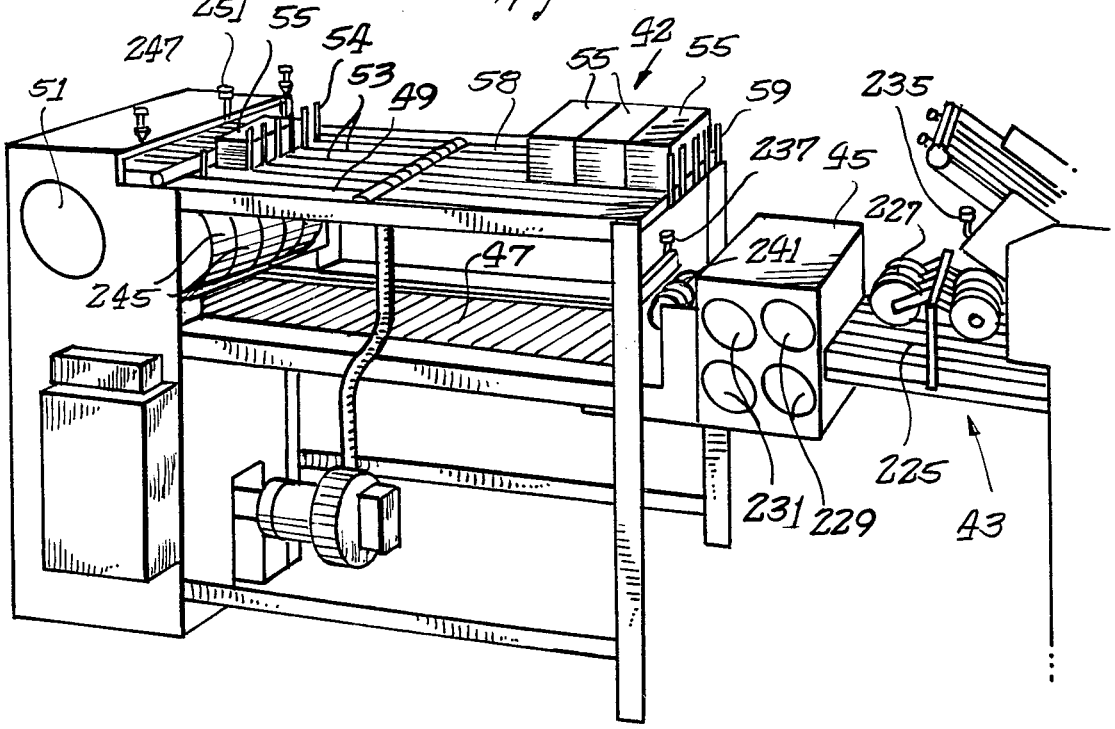
FIG. 15 is a perspective view of a shingle stacker device.

As best seen in FIG. 15, the signatures leaving the folding station 14 are conveyed by a belt conveyor 43 into a compressing station 45 at which the signatures are compressed to remove air between the folds and the folded sheet sections are flattened and pressed together. The signatures are shingled and are stopped on a belt conveyor 47 by pivoted stop belts 49. When a predetermined stack count of signatures are on the belt conveyor 47, the stop belts 49 are raised and the shingled signatures are fed around a drum 51 to abut retractable stop fingers 54 by means of a belt conveyor 53. The incoming shingled signatures lift the signatures thereabove and increase the stack height until the signature stack 55 is completed, e.g. about fifty signatures to a signature stack although this may be varied. Signature stacks 55 are conveyed forwardly by a signature stack conveyor 58 to abut stop bars 59. Thus, incoming shingled sheets 11 may be folded into signatures and automatically stacked into the signature stacks 55.

Figure 4:
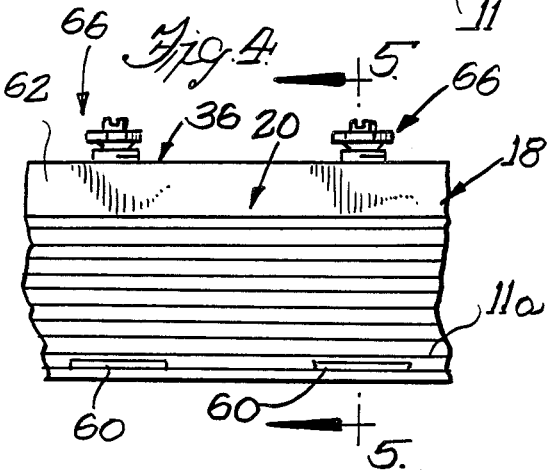
FIG. 4 is a partial fragmented view of an air levitation bar with stacked sheets being levitated.

Referring now in greater detail to the illustrated and preferred embodiment of the invention, the illustrated folding and stacking device 10 comprises a pair of opposed stands or frames 52 and 53, as best seen in FIG. 1, each of which support a side air bar 36 and 37. The preferred air bars have inwardly facing lower flanges 56, as best seen in FIGS. 4, 5 and 6, which are disposed generally horizontal and which can support the lateral edges 28 and 29 of the lower sheet 11*a* in the stack. The bar, as illustrated herein, is generally of a rectangular, hollow construction and receive compressed air in their hollow interiors 57, which air, as shown by directional arrows in FIG. 5 exits through a series of spaced outlet slots 60 which are located in the lower ends of inwardly facing vertical side walls 62 on the air bars. In accordance with the illustrated and preferred embodiment of the invention, the air bars are fed with air through common inlet hoses 64 which are connected to an air compressor means, with the air flowing from each hose 64 into the hollow center of a longitudinally extending central channel 65 (FIG. 5) which is disposed in the air bar interior. To adjust and control the amount of air being used to separate the sheets in the stack, the air levitating means 34 includes a plurality of individual air control valves 66 located on and spaced longitudinally along each air bar. The air valves are preferably provided with manually and exteriorily threaded members 67 which can be threaded to move a valve stem 68 vertically to unseat a valve tip 69 from a valve seat 70 in the top of the air channel 65. This valving action allows selective control longitudinally of the amount of air which is directed through each of the slits 60 extending along the length of the air bars 36 and 37. Thus, the operator can turn the air valves 66 to adjust the amount of air needed to provide the desired levitation of the sheets.

It is preferred to have another or rear back positive pressure air levitating block 39, as best seen in FIG. 6, which is connected to an air hose 72 with air being discharged from slits 74 at the bottom of the air block 39 to provide air levitation at the central rear portion of the sheets and extending fowardly and outwardly to support the bottom sheet. The air raises the center portions of the sheets and keeps the center sheet portions floating and keeps the center portion of the lowermost sheet 11*a* up at level of the flanges 56 on the air bars 36 and 37. This assists in the bottom sheet 11*a* being picked off and fed under the front stops 25. The preferred or illustrated block 39 has a magnetic lower base 77 for magnetic attraction to a horizontal metal base plate 78 extending between and fastened to the side stands 52 and 53. The air block can slide along the base plate 78 to any desired position by the operator, with its position depending on the length of the sheets and on the amount of air desired to reach the rearward edges 27 of the sheets in the stack. It should be noted that the air block is disposed underneath the discharge end (FIG. 8) or the transfer conveyer 16 so that the sheets pass thereover in their passage to abut the front stops 25 which are at a higher elevation to stop the forward movement of the incoming sheet to the top of the stack.

As will be explained in detail hereinafter, it is preferred that the lower joggers 26 extend upwardly through apertures 80 in the base plate 78 which are sufficiently enlarged to allow the oscillatory movement of the upstanding rear joggers 26. On the other hand, the lower edges 83 of the front stops are spaced upwardly of the base plate 78 so that only the single lowermost sheet 11*a* may pass below the lower edges 83 of the front stops 25 when the lowermost sheet is picked off by the vacuum cylinder 40.

Figure 8:
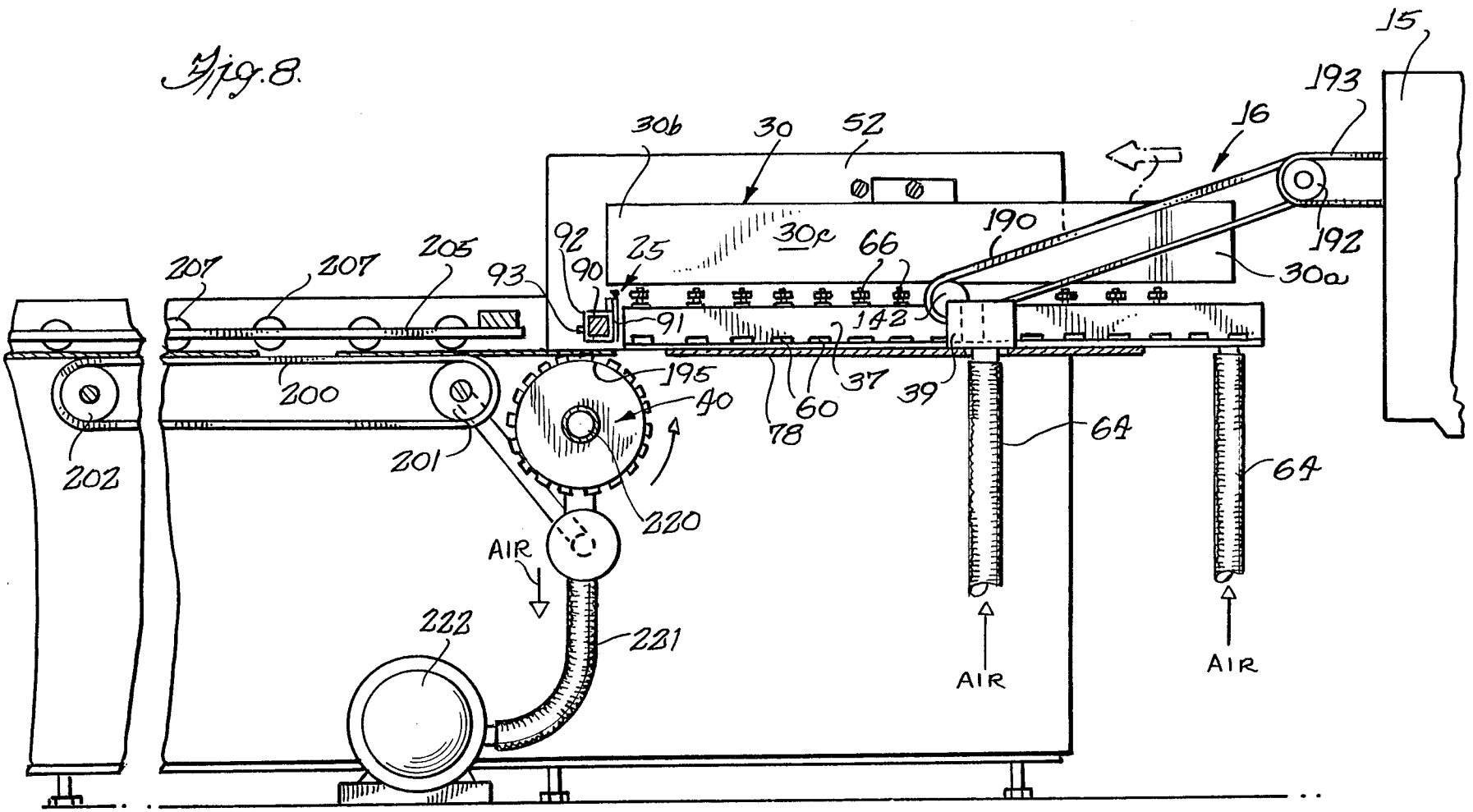
FIG. 8 is a partially cross section view showing the air and suction lines.
Figure 16:
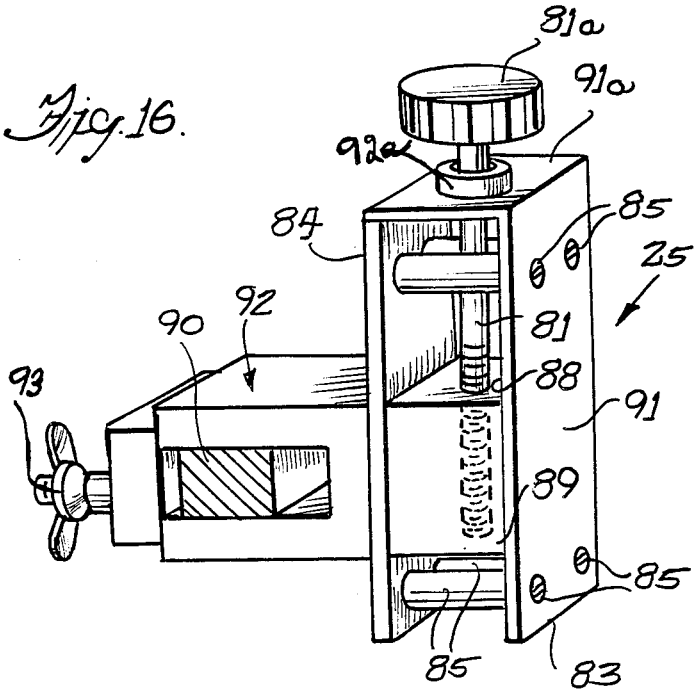
FIG. 16 is a partially fragmented view of a front stop and a caliper adjustment device therefor.

The front stop 25 for stopping the sheets 11 comprises, in this instance, as best seen in FIG. 8, a transverse rod 90 which spans the two side stands 52 and 53. Preferably, this rod carries these stop plates 91, each of which is mounted on a slideable bracket 92 slidably mounted on the rod 90 and secured in an adjusted lateral position by a screw 93 which can engage the rod 90. Preferably, the stop plates 91 are mounted for vertical adjustment to position their lower edges at the desired height relative to the support horizontal base plate 78. As best seen in FIG. 16, the preferred stop plates 91 are mounted to an infinitely variable vertical movement to provide a caliper function to define a slot height whereby only one and not two sheets is picked off by the vacuum cylinder 40. Thus, it will be seen that the front stop plates may be positioned at the desired heights relative to the base plate and at the desired locations to define the front edge of the the stack 20 relative to the underlying rotating suction cylinder 40 which picks off only the lower sheet 11*a* near the leading edge thereof.

As best seen in FIG. 16, the preferred front stop 25 may have the front stop plate 91 mounted on the slideable bracket 92 and rod 90 for vertical, caliper movement by turning a thumbscrew 81*a* mounted on the upper end of a vertical, threaded shaft 81. The shaft 81 is rotatably mounted by collars 92*a* located above an upper horizontally bent portion 91*a* of the stop plate 91 with the lower threaded end of the shaft 81 threaded into a nut portion 89 of slideable bracket 92. Another split plate 84 parallel to the stop plate 91 is secured thereto by stand off posts and screws 85. The split plate is located on opposite sides of the nut portion 89. A rear vertical surface 88 on the stop plate slides along the front vertical surface of the nut portion as the thumbscrew 93 is turned to raise or lower the lower edge 83 to provide a calipered thickness to allow only a single sheet 11*a* to be pulled from the bottom of the stack.

Figure 9:
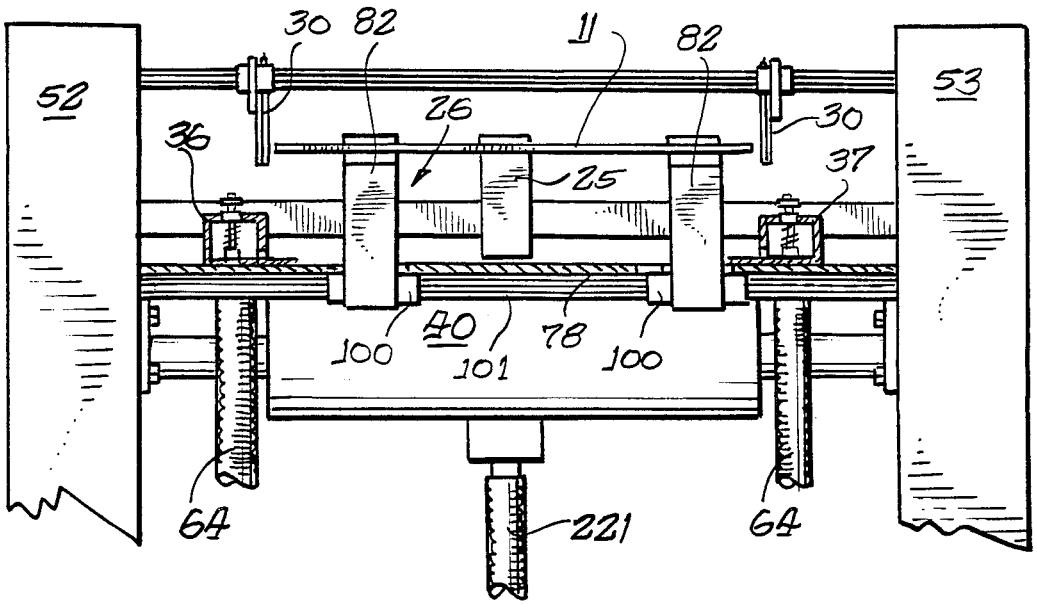
FIG. 9 is a partially cross sectioned view showing the joggers and stops for the sheets.
Figure 13:
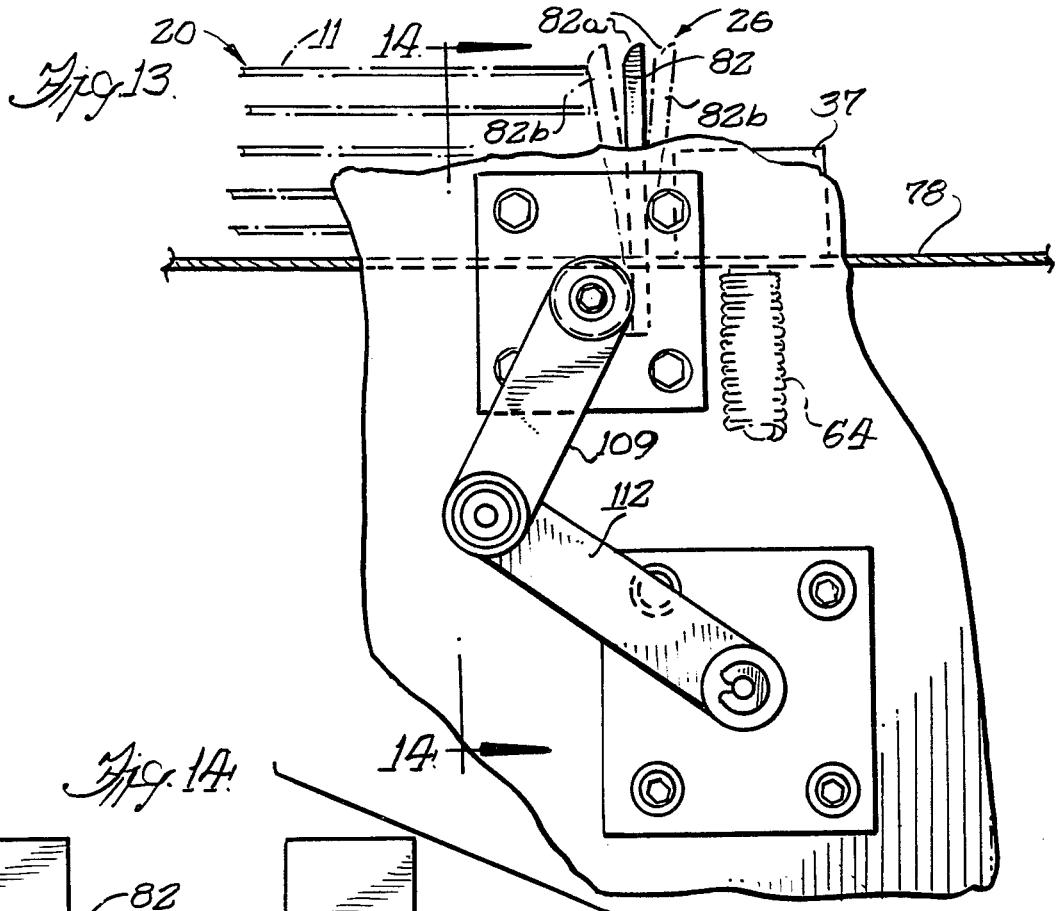
FIG. 13 is a partially fragmented side view of a drive for the rear jogger.
Figure 14:
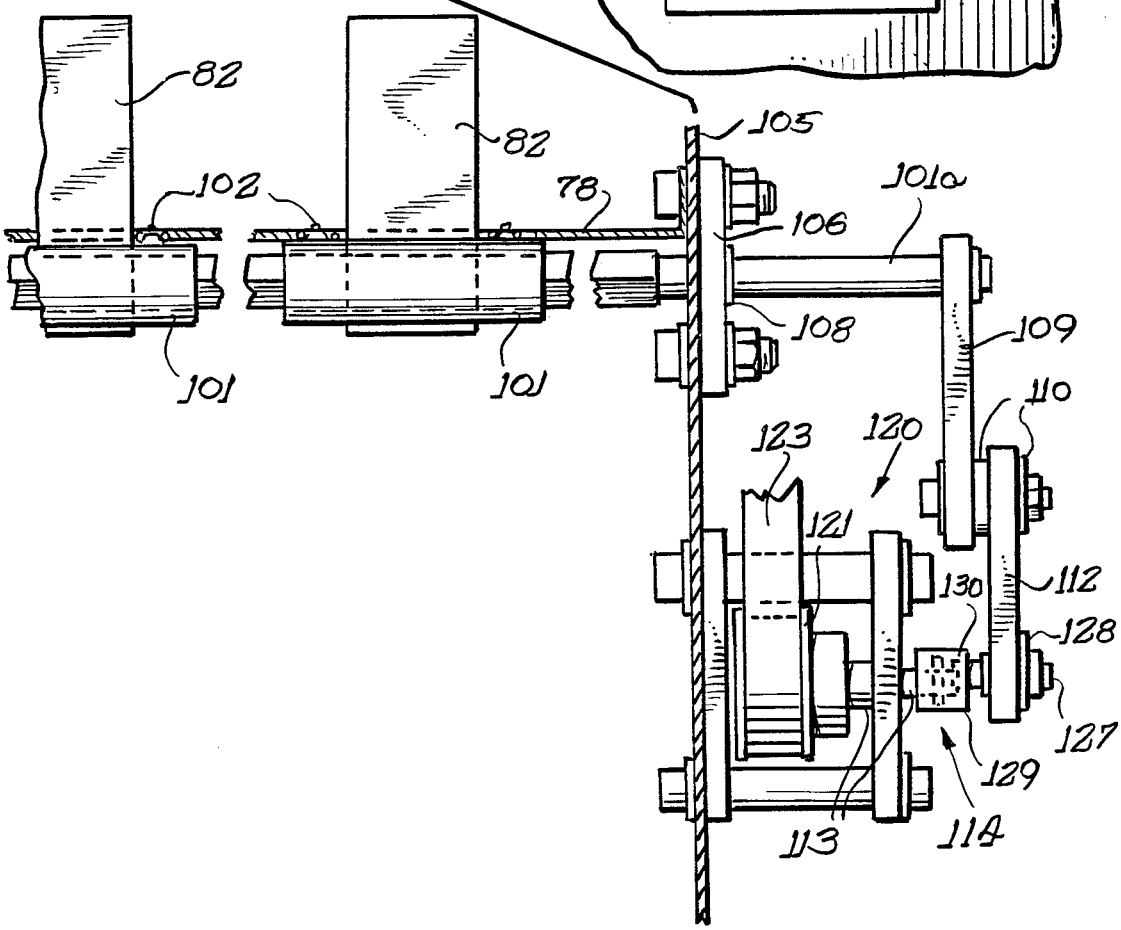
FIG. 14 is a cross sectional view taken substantially along the line 14—14 of FIG. 13.

The illustrated and preferred back jogger 26 includes the vertically extending fingers 82 which are in the form of upstanding rectangular plates fixed at their lower ends to slideable blocks 100, as best seen in FIGS. 9 and 14, which are slideable laterally along a rectangular rod 101 and fixed to the rod 101 by screws 102. The rectangular plates 82, as best seen in FIG. 13, have their upper edges beveled at 82*a* in the rearward direction. Thus, the lower non-beveled surface 82*b* will be forwarded hitting the lower sheets in the stack prior to the upper beveled edge 82*a* hitting the topmost sheet in the stack. The rod 101 extends between the side frames 53 and 52, as best seen in FIG. 9. As best seen in FIG. 14, the side frame 52 includes a vertical inner side frame plate 105 on which is mounted a bearing bracket 106 which has a bearing 108 mounting the shaft 101 for turning about a horizontal axis to oscillate the upstanding rear jogger fingers.

Figure 10:
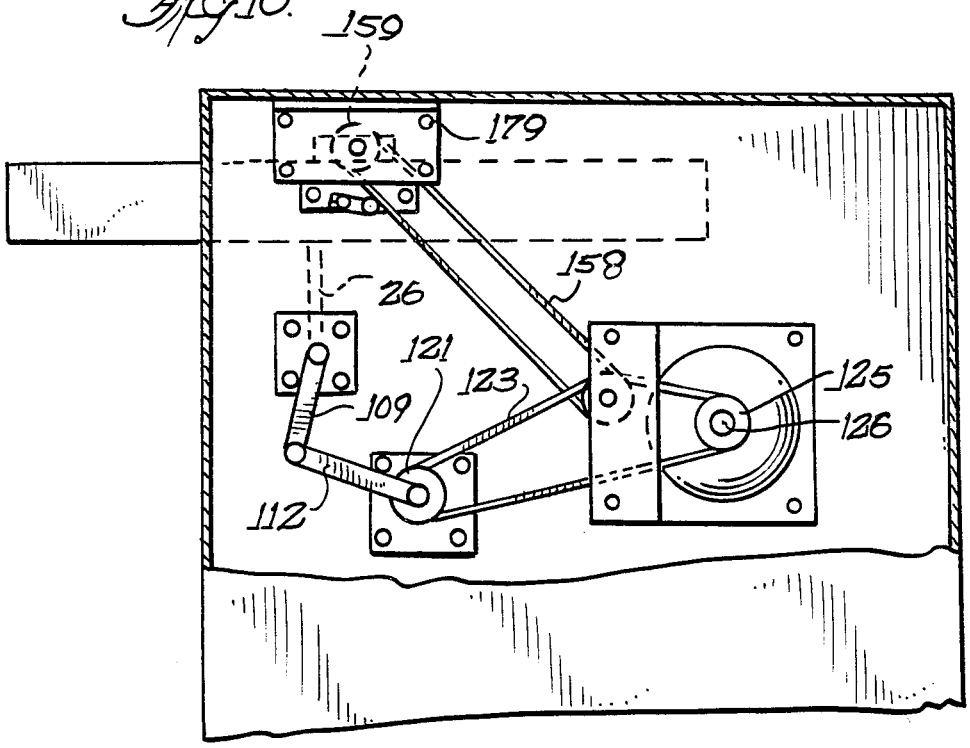
FIG. 10 is a view of a drive for the side and rear joggers.

To oscillate the rear jogger fingers 82 in the manner shown in FIG. 13, outer end 101*a* (FIG. 14) of the shaft 101 has a square end on which is mounted a link 109. The lower end of the link 109 is connected by a bearing mechanism 110 to the upper end of a crank arm 112 which is connected at its lower end to an eccentric mechanism 114 driven by a drive shaft 115. The drive shaft is mounted in a bracket 120 and carries at its inner end a cogged sprocket wheel 121 which is driven by a toothed timing belt 123. The timing belt 123, as best seen in FIG. 10, extends to and is driven by a drive sprocket wheel 125 which is driven by a motor shaft 126. The drive shaft 115 has its axis offset with respect to an output stub shaft 127, as shown in FIG. 14, on which is carried a bearing 128 for mounting to the lower end of the crank arm 112. By turning plates 129 and 130 of the eccentric mechanism 114 relative to each other the amount of throw of the eccentric may be varied to change the amount of displacement of the back jogger 26. Thus, it will be seen that the shaft 126 turns the sprocket 125 to drive the timing belt 123 and the cogged wheel 121 to turn the shaft 115 which turns the eccentric mechanism and its throw determines the amount of angular movement of the crank 112. The latter pivots the link 109 and turns the shaft 101 to oscillate the rear jogger plates 82. The amount of oscillatory movement may be adjusted to that desired, which by way of example, is through approximately $\frac{1}{8}$ inch to $\frac{1}{4}$ inch.

The rear jogger fingers 92 are oscillated at the same speed as the side joggers 30 and this speed is usually at about 700 to 1000 oscillations per minute. The sheets will have different thicknesses and stiffness as well as different widths between the air bars 36 and 37. For instance, the illustrated sheets have a 17 inch width between the air bars and extend 11 inches in the direction of conveyor feed. Other sheet sizes such as 17 by 22 inches or 11 by 11 inches may be stacked and folded with the illustrated equipment by adjusting the position of the side bars 36 and 37, the joggers, the rear air block 39 and the location of the pickoff cylinder 40 relative to the front stop 25.

Figure 11:
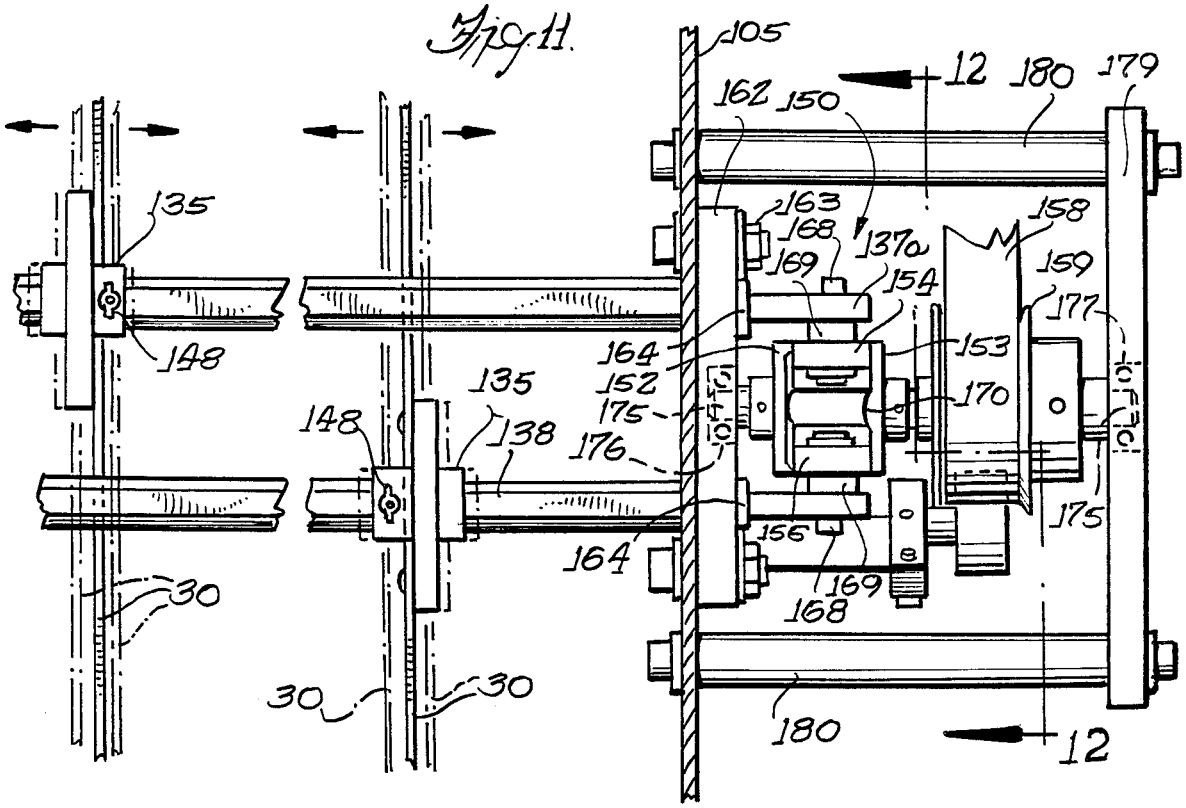
FIG. 11 is a fragmentary, cross sectional view showing the cam drive for the side joggers.
Figure 12:
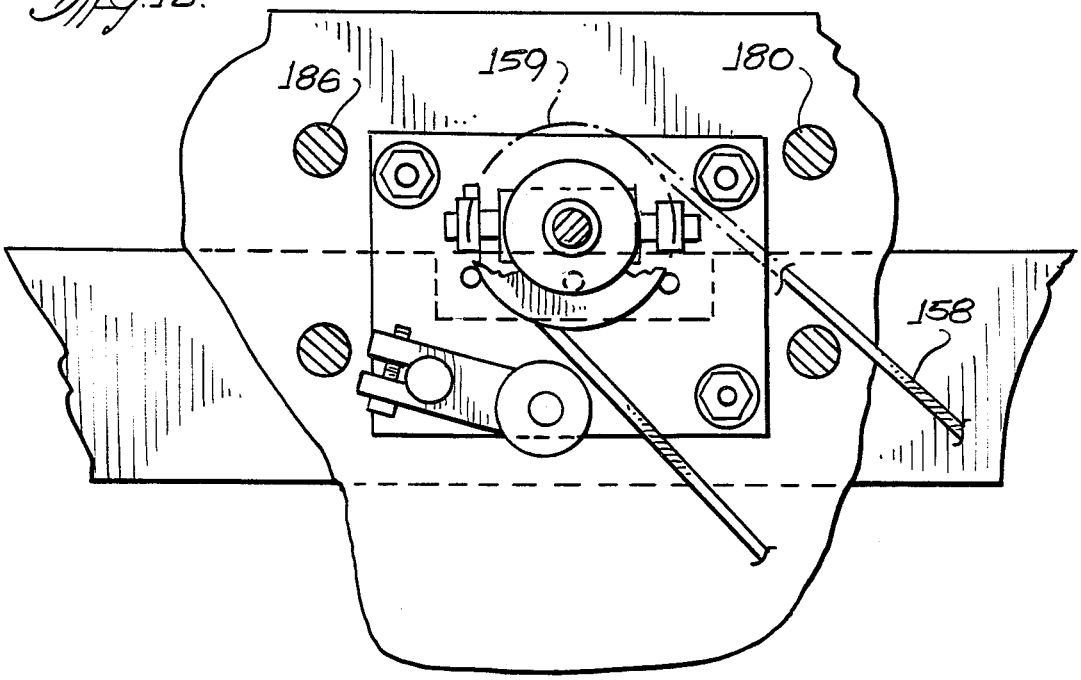
FIG. 12 is a cross sectional view taken substantially along the line 12—12 of FIG. 11.

As is best seen in FIG. 11, the respective side joggers 30 comprise a pair of longitudinally extending rectangular flat plates which are mounted by mounting blocks 135 at their upper edges to each of a pair of respective reciprocating shafts 137 and 138. As will be described in greater detail in each of the respective shafts and their side jogger plates move in the lateral direction between the positions shown in full and in phantom lines in FIG. 11 to engage lateral edges 28 and 29, respectively, of the sheet to center the incoming sheet 11 on the conveyor therebetween as well as the stack, equally between the right and left side jogger plates 30.

As best seen in FIG. 6, it is preferred that the side jogger 30 have outwardly diverging ends 30*b* at the forward ends to prevent any sheets from catching on the edges of the side joggers. The illustrated side joggers are relatively long in the longitudinal direction and extend from ends 30*a* located rearwardly of the discharge end of the incoming transfer conveyor as best seen in FIG. 8, to forward ends 30*b* located adjacent the front stop 25. As best seen in FIG. 8, the height of the side joggers relative to the lower discharge end of the transfer conveyor 16 is such the incoming shingled sheets on the transfer belts may begin to be jogged by the side joggers while they are still shingled and prior to their being discharged at the forward conveyor roller 142, as best seen in FIG. 8.

Preferably the side edge guides 30 have their inner facing surfaces 30*c* disposed generally parallel and in vertical alignment with the outer surface of the inner wall 62 of the respective air bars 36 and 37. Thus, the edges of the incoming sheets are aligned to fall downwardly along the inner walls 62 of the air bars with their lateral edges 28 and 29 positioned over the side edge flanges 56 to be suspended along the edges, as best shown in FIG. 5. The lateral position of the respective side joggers is adjusted by sliding their respective slideably mounting blocks 135 along their respective shafts 137 and 138 and then locking the same thereto by a screw fastener 148 (FIG. 11).

The preferred and illustrated drive for oscillating the respective side joggers 30 through equal and opposite increments includes a cam drive means 150 (FIG. 11), as will now be explained in greater detail. The cam drive means includes a pair of spaced cams 152 and 153 which drive respective cam followers 154 and 155 which are respectively associated with the slideable shafts 137 and 138 to slide the same in a lateral direction. The incoming drive to turn the pair of cams 152 and 153 is from a driven timing belt 158 which is connected to and drives a sprocket wheel 159 mounted on a rotatable shaft 175.

Turning now in greater detail to the illustrated cam drive 150 for sliding the shafts 137 and 138, there is provided a mounting plate 162 which is secured by fasteners 163 to the vertical side plate 105 of the side stand 53. The mounting plate 162 carries separate slide bushings 164 for each of the respective shaft ends 137*a* and 138*a* which project through the slide bushings 164 to the cam followers 154 and 155. These shaft ends each carry a stub shaft 168 which projects at a right angle thereto and each stub shafts carries a bearing 169 for rotatably mounting one of the respective rotatable cam followers 154 and 155. The illustrated stub shafts 168 and 169 are aligned on a common horizontal axis. The cam followers are driven by the respective cams 152 and 153 each of which have cam lobes 170. The cams are secured to the rotating shaft 175 which is mounted at its inner end in a bearing 176 carried by the mounting block 162. Thus, the inner facing end of the shaft 175 is journaled for rotation in a bearing 176. The opposite end of the shaft 175 turns in a bearing 177 mounted in a bracket plate 179 which is mounted by suitable standoff posts 180 to the frame plate 105. The toothed sprocket wheel 159 is secured to the shaft 175 so that as the gear belt 158 rotates it turns the sprocket 159 and the shaft 175 to simultaneously rotate the respective cams 152 and 153 against the cam followers 154 and 155 which are secured to the ends 137*a* and 138*a*, respectively, of the shafts 137 and 138 to slide the same laterally in the slide bushings 164. Herein the preferred reciprocating movement of the shafts are such that as the shaft 137 is moving to the left while the shaft 138 is moving to the right. The lateral displacement is approximately about ⅛ of an inch, although this may vary and still fall within the purview of the present invention.

The illustrated transfer conveyer 16 comprises, as best seen in FIGS. 1, 6 and 8, a series of spaced inclined belts 190, which are driven about the front roller 142 at their lower front discharge ends which discharge the sheets 11 into the stacking station 18. At the upper and rearward ends, the belts 190 are trained about rollers 192 which also support the forward ends of belts 193 which are conveying the sheets directly from the web printing press 15. Thus, a continuous stream of shingled sheets will be transported on the tops of the belts 193 as viewed in FIG. 8 and then are carried downwardly by the inclined transfer belts 190 with the side joggers 30 oscillating to abut lateral edges 28 and 29 of the sheets to center the sheets therebetween while still on the conveyer belt 190 so that as the sheets drop they will drop past the inward facing side walls 62 of the respective air bars and be held on top of the stack of sheets.

The sheets 11 are jogged while in the stack 20 and once each revolution of the vacuum pick off cylinder 40, it brings a port 195 up to the forward leading edge 24 of the lowermost sheet 11*a* in the stack to pick the same off and to bring this sheet edge onto the upper surface of a series of alignment conveyer belts 200. The vacuum cylinder is conventional and it is moved forward or rearward relative to the lower caliper edge 83 of the front stops 25 by shifting the location of the motor driven shaft 220. For thin sheets, the shaft 220 is shifted rearwardly to allow more wrap of sheets about the cylinder before release from the ported cylinder 40. The respective alignment conveyer belts 200 extend to the left as viewed in FIG. 8 between a pair of rollers 201 and 202 and carry the sheets forwardly. The sheets are held downwardly on the top of the conveyer belts 200 by a known device which includes an upper holder 205 in which are mounted a series of rotatable ball bearings 207 which roll on top of the sheet to hold the sheet down, and yet, allow the sheet to be moved along a slightly inclined path to the left as seen in FIG. 7 against the stationary side guide 41. Thus, each of the sheets has its side edge 28 sliding along the side guide 41 as the belts carry the sheets into the folding station 14. At the folding station the leading end of the sheet is conveyed up to hit the abutment stop 46 (FIG. 3) causing the sheet's central portion to buckle at the fold 12 which is gripped in the nip of a pair of oppositely rotating folding rollers 48. The sheet fold is fed between the rollers 48 and through a series of rollers (not shown) but in a well known commercially known manner to complete a folded signature leaflet which is then dropped onto output conveyer 50.

Because as many as 80,000 signatures may be issuing per hour from the folding station 14, the preferred apparatus has appended thereto a shingle stacker, which is illustrated herein, as "multiplo" shingle stacker sold by OMG Manufacturing Company of Milan, Italy. Manifestly, other shingle stackers could be used in lieu of the illustrated shingle stacker and other belt conveyors and pins may be used to accumulate the signatures.

As best seen in FIG. 15, the conveyor 43 has belts 225 with pairs of overhead hold down rollers 227 holding the signatures against the belts 225. The conveyor 43 delivers the folded signatures into the pressing station 45 at which are located a first set of compression rollers 229, which press on opposite sides of the folded signature to push the air from between the sheets. The sheets leave a nip of the first set of compression rollers 229 and are delivered into the nip of the second set of compression rollers 231 where they are further flattened with their fold lines being creased. Prior to passage of the sheets to the pressing station, the sheets pass beneath a photocell detector or sensor 235, which counts the sheets to the predetermined count for the stack, such as fifty sheets per stack. The photocell 235 is mounted at the location of the hold down rollers 227 before the pressing station 45. To make sure that these sheets are always shingled for stacking, another photocell 237 is provided to scan the sheets leaving the pressing station 45. This photocell is located adjacent hold down rollers 241 of the belt conveyor 47. The pivotly mounted belt front stops hold the forward sheets on the conveyor belts 47 until such time as fifty sheets have been accumulated. Whereupon the photocell 237 causes a crank actuator not shown to raise the belt stops allowing the drum and conveyor belts 245 and 247 to cause the shingled sheets to move around from the lower side of the drum to the top side of the drum to abut the now raised stop fingers 54. Each of the incoming folded signatures slides beneath the bottom of the stack and raises the stack along the fingers until all fifty sheets have been accumulated against the stop fingers 54. A photocell 251 just prior to the stacking fingers in stacking station for the signatures detects the absence of a sheet and operates a control actuator to lower the stack fingers 54 whereby the belts 53 may move the stack over the top of the now lowered fingers to the conveyor belt 58 which has stacked thereon a number of stacks of identical number of signatures with the first stack abutting finger-like stops 59 adjacent the ends of the belts 58.

As an aid to the understanding of the invention, a brief review of the illustrated preferred apparatus will be provided. The incoming printed sheets which are unfolded leave the web printing press on belts 193 (see FIG. 6) and are conveyed to a transfer conveyer 16 which preferably includes downwardly inclined belts 190 which bring the leading edge of the incoming sheet through the inlet tapered ends 30*a* of the side joggers 30 which can begin to side jog the sheet while it is still on the belts 190 and is being moved to be discharged over the top of lower rear joggers 26. The leading edge of the incoming sheet abuts the upstanding front stops 25 and is limited thereby from moving forwardly and as the side edge joggers 30 are oscillating laterally, as best seen in FIG. 11. As the sheet drops onto the top of the stack 20, the rear jogger 26 is moving in the forward direction jogging and tamping the rear edge 27 of the sheet as best seen in FIG. 13. Thus, the incoming sheet is being centered on top of the stack as it is being deposited on top of the sheets which are held suspended by a cushion or curtain of air generating from the air side bars 36 and 37 and also in this instance by a rear air levitating block 39 positioned rearward of the rear joggers 26, as best seen in FIG. 6. A suitable adjustable nut 67 on the top of each of the air valves 66 allows variation of the amount of air issuing from the respective slits 60 in the side air bars so that the sheets are vibrating and are suspended and separated by air in the desired manner. Thus, the vibrating sheets are suspended and are being centered between the respective side joggers 30 and held with their forward edges against the front stop 25 so that all of the sheets in the stack are aligned and positioned for discharge from the bottom of the stack by means of a pickoff vacuum cylinder 40 which rotates about a motor driven shaft 220 (FIG. 8). A mechanical pickoff would be too slow.

Each revolution of the pickoff cylinder 40, whose speed can be adjusted to match the feed of the sheets incoming from the printing web press, is picked off from the bottom of the stack 20. The vacuum cylinder 40 is connected by an air hose 221 to a vacuum pump 222. Each bottom sheet 11*a* is slid under the front stop 25 and onto the top of the alignment conveyer belt 200, at which are overhead ball bearings 207, with the alignment conveyer moving the left edge of the sheet as seen in FIGS. 7 along the vertical side guide wall 41 to precisely position the sheet in a known manner for movement into the folding station 14 to bring the leading edge 28 of the sheet against the abutment bar 46 on the folding plate 44 which causes the center fold 12 of the sheet to buckle into the nip between the counter rotating folding rollers 48 which are part of a series of rollers which then fold the sheet to form a signature which is fed to the conveyor 43 in a folded condition with the fold 12 forwardly as best seen in FIG. 3. The folded signatures are then pressed flat in the pressing station and counted by the photocell 245. The leading ones of the shingled signatures are held on the conveyor 47 until count is reached and then stop belts 49 are pivoted upwardly to release these signatures to travel about the drum 51 to abut the now raised stop fingers 54. When all fifty of the signatures are in the stack, the photocell 251 detects the absence of incoming signatures and lowers the stop fingers allowing conveyors 53 and 58 to convey the stack to join the other signature stacks.

From the foregoing it will be seen that the present invention provides a new and improved folding capability for a web printing press, although it may be used without direct connection to the printing web press. The apparatus is particularly adjustable with large adjustments being made to handle different sizes of sheets and with fine micro adjustments to assure a proper positioning of the sheet edges in the stack and for movement into the folding station.

While it is appreciated that the illustrated and preferred folding device having folding plates is the preferred embodiment of the invention, it is to be understood that another folder device may be substituted therefor. The illustrated and preferred shapes of the joggers and air levitation devices may be changed as well as other devices may be added and still fall within the purview of the present invention. It would be possible to hand load the stacking station with signatures rather than using a transfer conveyor from a web printing press.

Also, rather than using a shingle stacker as illustrated, the folded signatures from the folding station 14 may be merely conveyed away in shingled fashion on conveyor belts to abut upright fingers to form stacks which can be manually removed.

While a preferred embodiment has been shown and described, it will be understood that there is no intent to limit the invention by such disclosure but, rather, it is intended to cover all modifications and alternate constructions falling within the spirit and scope of the invention as defined in the appended claims.

The in-line web printing press 15 will be discharging shingled sheets at a rate set the press operator and operator of the stacking and folding machine 10 will set its speed of operation to match that of the web printing press. To this end, it is preferred to have an electric counter device 260 (FIG. 1) connected to a photocell 262 with the photocell actually counting each sheet passing underneath it on the alignment conveyor 22. A digital counter 264 on the electric counter device displays the operating speed so that the operator can match the speed precisely to that of the in-line web printing press. An electric motor control means 266 has an adjustable knob 268 which changes the speed of the motor 270 which has its motor drive shaft 126 (FIG. 10) driving the side joggers 30 and the rear joggers 26. A motor 272 (FIG. 1) drives the alignment conveyor 22 and its speed may be adjusted by the operator at motor control device 274 having a control adjustment knob 276. The Motor controls 266 and 274 are interconnected by electric leads 278. Thus, the speed of the operation of the vacuum cylinder 40, the alignment conveyor 22 and the joggers 30 and 26 may be correlated and adjusted to the speed of the web printing press. The press speed is also varied for different types of paper to achieve the best performance and the speed control knobs 268 and 276 may be operated to vary the speeds in fine increments by the stacking and folding machine operator as he views the stacking operation and folding operation as well as the count on the digital counter 264.

What is claimed is:

1. An apparatus for stacking thin, non-folded, flexible sheets, feeding sheets from the stack and for folding the sheets comprising the combination of:

a conveyor for continuously feeding a stream of shingled sheets at a predetermined speed into a stacking station and for dropping the sheets while still shingled one by one on top of the other to form a stack of sheets at the stacking station, a front stop in the stacking station abutted by the imcoming sheets to limit their forward travel and to define the forward location of the stack of sheets, a back jogger means located at the back of the stack for jogging the rearward edges of the incoming sheets and the sheets in the stack toward and against the front stop, side jogger means for jogging the incoming lateral sides of the sheets to align the sheets with their lateral edges aligned within the stack, air levitating means for providing a layer of air between sheets in the stacking station for separating the lowermost sheets in the stack by air while the sheets are being jogged, bottom suction feed means including a continuously rotating suction roller for gripping the leading end of the bottom sheet of the stack while incoming sheets are being stacked on top of the stack in the stacking station, means defining a gap at the lower front end of the stacking station to allow passage of only the lowermost sheet through the gap, a continuously operating conveyor means for conveying each sheet from the stacking station to a folding station, adjustable speed conrol means to adjust the speed of the vacuum cylinder and conveyor means relative to that of said conveyor continuously feeding shingled sheets to said stacking station to prevent an over or under accumulation of sheets in the stacking station, and folding means at the folding station for folding a continuous stream of sheets being fed from the stack hy the conveyor means.

2. An apparatus in accordance with claim 1 in which the back jogger includes a pair of oscillating jogger fingers mounted on a shaft and cam means for oscillating the shaft to oscillate the fingers against the rearward edges of the sheets.

3. An apparatus in accordance with claim 2 in which the side jogger means comprises a jogger plate extending longitudinally along each of the lateral sides of the sheets and movable in the lateral direction toward and from the adjacent sheet edge.

4. An apparatus in accordance with claim 3 in which the side jogger means include side jogger shafts each supporting one of said side jogger plates with the shafts being moved to and fro in a lateral direction, and cam means for alternatively moving each of the side jogger shafts to move side jogger plates thereon to jog the lateral sides of the sheets in the stack.

5. An apparatus in accordance with claim 1 in which the air levitating means comprises a pair of side air bars each extending laterally along the lateral edge of the sheets with air outlets disposed adjacent the bottom of the stack and adjacent side edges of the sheets for levitating the sheets at the bottom of the stack.

6. An apparatus in accordance with claim 5 in which the air levitating means includes a rear air discharge means for discharging air under pressure at the rear portions of the sheets to assist the side air bars in levitating the sheets.

7. An apparatus in accordance with claim 5 in which said side air bars include a plurality of adjustable air valves for controlling the amount of airflow to levitate the stack.

8. An automatic stacking and folding apparatus for thin, flexible non-folded sheets comprising:

sheets and to deposit shingled sheets in a stacking station, means defining the stacking station for receiving incoming sheets and for holding a series of stacked sheets with the sheets incoming onto the top of the stack and being fed automatically from the bottom of the stack, means for engaging the forward edge of the incoming sheets to limit their forward travel and to define the forward end of the stack of sheets in the stacking station, side jogger means for jogging at least one side of the incoming sheets to align the lateral sides of the sheets within the stack, rear jogger means for jogging the rear edge of the incoming sheets to align the rear sheet edges within the stack, air levitating means for levitating sheets within the stack, bottom feed means including a continuously rotating suction roller for removing the bottom sheet from the stack and for feeding the sheet forwardly to a folding station, a continuously operating conveyor means for feeding sheets removed from the bottom of stack to the folding station means for adjusting the speed of the continuously rotating suction roller and the speed of the continuously operating conveyor means to prevent an over or under accumulation of sheets in the stacking station, variable adjustable speed matched to the incoming conveyor means speed, folding means at a folding station to fold the sheets being received from said conveyor means.

9. An apparatus in accordance with claim 8 in which said means for engaging the forward edge of the incoming sheets is a stationary stop and in which said rear jogger means continuously pushes the sheets forwardly against the stop.

10. An apparatus in accordance with claim 9 in which a transfer conveyor feeds a continuous stream of shingled sheets into the stacking station and in which said side jogger means extends along the transfer conveyor to jog sheets thereon.

11. A method of feeding thin, unfolded sheets from a web press to a folding station for folding comprising the steps of:

conveying a continuous stream of shingled sheets at a predetermined rate in excess of 10,000 sheets per hour from a printing press to a stacking station, and discharging sheets while still shingled onto the top of stack of sheets in the stacking station, jogging the incoming singled sheets, at the top stack and the stack of sheets to align the edges of the sheets in the stack in the stacking station, levitating the sheets in the bottom of the stack with air to separate the sheets at the bottom for feeding from the stack, bottom feeding the bottom sheet from the stack by continuously rotating a suction roller which grips the leading edge of the lowermost sheet from the stack and pulls the sheet forwardly from the stack, conveying a continuous stream of sheets on a conveyor means from the stacking station to a folding station, adjusting the speed of the rotating suction roller and of the conveyor means to remove and carry sheets from the stacking station at a rate to prevent over or under accumulation of sheets in the stacking station, and folding the sheets while they are continuously moving through the folding station.

12. A method in accordance with claim 11 including the step of separating and suspending the sheets in the stacks with air.

13. A method in accordance with claim 12 including the steps of feeding the folded signatures from the folding station in a shingled manner to a signature stacking station and stacking the incoming signatures in the stacking station.

14. A method in accordance with claim 13 including the step of compressing the folded signatures prior to stacking and counting the number of signatures and forming stacks of equal counts at the stacking station.

15. An apparatus for stacking thin, unfolded, flexible sheets, feeding sheets from the stack and for folding the sheets into signatures and for forming stacks of signatures, said apparatus comprising the combination of:

a conveyor for continuously feeding a stream of shingled sheets into a stacking station and for dropping the sheets one by one on top of the other to form a stack of sheets at the stacking station, a front stop in the stacking station abutted by the incoming sheets to limit their forward travel and to define the forward location of the stack of sheets, a back jogger means located at the back of the stack for jogging the rearward edges of the incoming sheets and the sheets in the stack toward and against the front stop, side jogger means for jogging the incoming lateral sides of the sheets to align the sheets with their lateral edges aligned within the stack, air levitating means for providing a layer of air between sheets in the stacking station for separating the sheets by air at the bottom of the stack while the sheets are being jogged, caliper means adjusted with a caliper precision adjustment for precisely sizing a gap at the bottom of the front stop through which a single sheet may pass with the sheet thereabove being held against removal, bottom suction feed means including a rotating suction roller for gripping the bottom sheet of the stack and for feeding each bottom sheet from the stack while incoming sheets are being stacked on top of the stack in the stacking station, a continuously moving conveyer means for removing the sheets from the stack after being started from the stack by the suction roller for conveying each sheets from the stacking station to a folding station, and folding means at the folding station for folding a continuous stream of sheets being fed from the stack by the conveyor means into signatures, signature conveyor means for conveying the signatures to a signature stacking station, and stacking means in the signature stacking station for stacking the incoming signatures into a stack.

16. An apparatus in accordance with claim 15 in which means counts the signatures and forms each signature stack with the same number of signatures therein.

* * * * *

UNITED STATES PATENT AND TRADEMARK OFFICE

CERTIFICATE OF CORRECTION

PATENT NO. : 4,616,815

DATED : October 14, 1986

INVENTOR(S) : Michael Vijuk

It is certified that error appears in the above-identified patent and that said Letters Patent is hereby corrected as shown below:

Claim 1, Column 11, line 53 change "imcoming" to --incoming--.

Claim 1, Column 12, line 18 change "hy" to --by--.

Claim 11, Column 13, line 41 change "singled" to --shingled--.

Signed and Sealed this

Third Day of February, 1987

*Attest:*

DONALD J. QUIGG

*Attesting Officer*

*Commissioner of Patents and Trademarks*